US005438858A

United States Patent [19]

Friedrichs

[11] Patent Number: 5,438,858

[45] Date of Patent: Aug. 8, 1995

[54] EXTRUSION TOOL FOR PRODUCING A HARD METAL ROD OR A CERAMIC ROD WITH TWISTED INTERNAL BOREHOLES

[75] Inventor: Arno Friedrichs, Kulmbach, Germany

[73] Assignees: Gottlieb Guhring KG, Ebingen; Konrad Friedrichs KG, Kulmbach, both of Germany

[21] Appl. No.: 162,137

[22] PCT Filed: Jun. 17, 1992

[86] PCT No.: PCT/EP92/01379

§ 371 Date: May 2, 1994

§ 102(e) Date: May 2, 1994

[87] PCT Pub. No.: WO93/24190

PCT Pub. Date: Dec. 9, 1993

[30] Foreign Application Priority Data

Jun. 19, 1991 [DE] Germany ..... 41 20 166.3

[51] Int. Cl.[6] ..... B21C 25/04

[52] U.S. Cl. ..... 72/260; 72/264

[58] Field of Search ..... 72/77, 253.1, 260, 264, 72/268, 269

[56] References Cited

U.S. PATENT DOCUMENTS

| | | |
|---|---|---|
| 281,711 | 7/1883 | Merrill . |
| T,869,007 | 12/1969 | Brown . |
| 1,684,312 | 9/1928 | Fischer et al. . |
| 2,138,378 | 11/1938 | Johnson . |
| 2,174,779 | 10/1939 | Delorme . |
| 2,778,059 | 1/1957 | Henning et al. . |
| 3,205,692 | 9/1965 | Kemppinen et al. . |
| 3,520,966 | 7/1970 | Soffiantini . |
| 3,574,810 | 4/1971 | Tournery et al. . |
| 3,651,187 | 3/1972 | Cessna, Jr. . |
| 3,651,195 | 3/1972 | Rasmussen . |
| 4,050,867 | 9/1977 | Ferrentino et al. . |
| 4,120,628 | 10/1978 | Simos . |
| 4,709,055 | 11/1987 | Barner et al. . |
| 4,921,414 | 5/1990 | Schliehe et al. . |
| 5,049,331 | 9/1991 | Hempel . |
| 5,116,659 | 5/1992 | Glatzle et al. ..... 72/260 |

FOREIGN PATENT DOCUMENTS

| | | |
|---|---|---|
| 0118035 | 9/1984 | European Pat. Off. . |
| 2348775 | 11/1977 | France . |
| 3600681 | 5/1987 | Germany . |
| 3601385 | 7/1987 | Germany . |
| 4021383 | 1/1992 | Germany . |
| 4211827 | 10/1993 | Germany . |
| 1161863 | 8/1969 | United Kingdom . |
| 2218928 | 11/1989 | United Kingdom . |
| 1574308 | 6/1990 | U.S.S.R. ..... 72/77 |

OTHER PUBLICATIONS

Patent Abstracts of Japan, JP-A-1 166816, Jun. 30, 1989.

Patent Abstracts of Japan, JP-A-63 278611, Nov. 16, 1988.

*Primary Examiner*—Lowell A. Larson

*Attorney, Agent, or Firm*—Oblon, Spivak, McClelland, Maier, & Neustadt

[57] ABSTRACT

The invention relates to a extrusion die tool for producing a hard metal or ceramic rod with at least one twisted internal bore (14). The nose (3) of the nozzle (2) has a smooth cylindrical channel (4). A bearer (6) is fitted coaxially inside the nozzle (2) which has a plurality of elastic threads (9) and/or channels or bores corresponding to the desired number of internal bores for the thread-shaped pressing of a plastic material into the extruded material. The bearer (6) and the nozzle nose (3) are rotary, i.e. they rotate about their longitudinal axes. The pitch of the twisted internal bores (14) produced is thus determined by the rotation speed of the thread bearer (6) and/or the nozzle nose (3) and the rate of flow of the extruded material. Rod blanks with high-precision helical internal bores (14) can thus be produced.

7 Claims, 1 Drawing Sheet

EXTRUSION TOOL FOR PRODUCING A HARD METAL ROD OR A CERAMIC ROD WITH TWISTED INTERNAL BOREHOLES

BACKGROUND OF THE INVENTION

The invention relates to an extrusion tool for producing a hard metal rod or ceramic rod having at least one twisted internal borehole, where the outer die ring of the extrusion die exhibits a smooth cylindrical channel.

Hard metal rods or ceramic rods having twisted, i.e. helical, internal boreholes, are further processed, for example, into drills. The twisted internal boreholes form the subsequent flushing and/or cooling channels to feed in the cooling and flushing agent. From the EP 01 81 035 it is known to twist the blank, emerging from the extruder, at an angular speed adjusted to the material flow, the desired drill geometry and to the helical course of the cooling channels by means of suitable twisting devices. To this end, additional twisting devices and adjusted controllers and regulators are required, in addition to the actual extrusion tool. The result of the twisting device attacking from outside the blank emerging from the extrusion tool is the undesired formation of scratches, contact marks and constrictions. An extrusion tool has become known from the DE 36 00 681 A1, where the extrusion compound is already helically twisted during the extrusion process. To this end, the extrusion tool exhibits a die, to whose inner shell is attached at least one flight, which extends helically in the squeezing direction and which forces radially from the outside a twisting motion upon the extrusion compound that is pressed through the die. To form the twisted boreholes, elastic pins are provided that project into the interior of the die and exhibit the desired flushing borehole diameter. No uniform twisting motion, acting over the entire cross section of the blank, can be produced with this extrusion tool, so that the necessary geometry of the . . . the twisted boreholes, elastic pins are provided that project into the interior of the die and exhibit the desired flushing borehole diameter. No uniform twisting motion, acting over the entire cross section of the blank, can be produced with this extrusion tool, so that the necessary geometry of the twisted internal boreholes can hardly be maintained and obtained. Due to the flights arranged on the inner shell of the die, no rod material with a smooth shell surface can be produced; rather shell and outer surface of the produced rod material exhibit pronounced helical impressions. In addition, the twist flights wear rapidly on account of the abrasive behavior of the processed hard metal or ceramic compound, so that the life of the tool is short. The re-conditioning of the dies, e.g. through internal erosion, is expensive and, thus, raises the cost of producing hard metal rods or ceramic rods. Finally, an extrusion tool has already been proposed that exhibits internally a twisting device, which is designed as a twisting screw and with whose aid the a twisting motion is conveyed to the extrusion compound within the extrusion tool during the extrusion process and said compound leaves with twist the outer die ring exhibiting a smooth cylindrical channel. The helical internal boreholes are formed by means of the elastic threads, attached to the twisting device, or by means of the thread-shaped material, emerging from the twisting device and squeezed into the melt stream.

The object of the invention is to further simplify the extrusion tool and to further improve the quality of the rod blanks thus produced.

This problem is solved with a device in that the carrier can be rotated around the longitudinal axis of the die, the flexible elements are formed by threads, and the outer die ring has the shape of a cylindrical ring exhibiting a smooth, cylindrical die channel. The problem is solved with the device in that, instead of the flexible elements forming the internal bore, the carrier exhibits channel openings or outlet openings to corresponding divided circles, from which thready, plastic material can be extruded into the extrusion melt stream. As stated above, the thread carrier and/or the outer die ring can be designed rotatably, i.e. the thread carrier and/or the outer die ring rotate(s) around the longitudinal axis.

Thus, no special twisting device is required that forces a twist upon the entire compound squeezed through the die. In the case of an extrusion tool according to the invention, the extrusion compound does not rotate, while the thread carrier and/or the internally smooth outer die ring is or are set into rotation. Thus, the angle of inclination of the twist channels that are produced is defined by the rotational velocity of the thread carrier and/or the outer die ring and the flow velocity of the extrusion compound. In the case of a rotating smooth die, thus a die or an outer die ring without protrusions, flights or the like, the result of the high extrusion pressure of the squeezing device and the surface friction of the die is that the emerging extrusion compound also rotates with virtually no slippage. In order to rotate the thread carrier a drive is disposed within the extrusion die. The thread carrier is shaped, according to another feature of the invention, as a hub tapering off in the direction of the outer die ring; that is, it exhibits the shape of a propeller hub without blades. Expediently the hub is designed as a hollow hub and exhibits several boreholes, lying on different divided circles, from which the threads are suspended. According to another feature, these threads carry on their ends, projecting into the outer die ring, metallic or other elements influencing the magnetic or electric field. In this manner the rotational velocity of the threads and thus indirectly the twist pitch with known velocity of extrusion of the plastic compound can be measured. Helical channels, which are arranged downstream rotationally symmetrically in the melt stream and which exhibit high precision, are produced by means of the threads of the thread carrier that are arranged at predetermined intervals and in predetermined number.

DETAILED DESCRIPTION OF THE PREFERRED EMBODIMENTS

Figure 1:
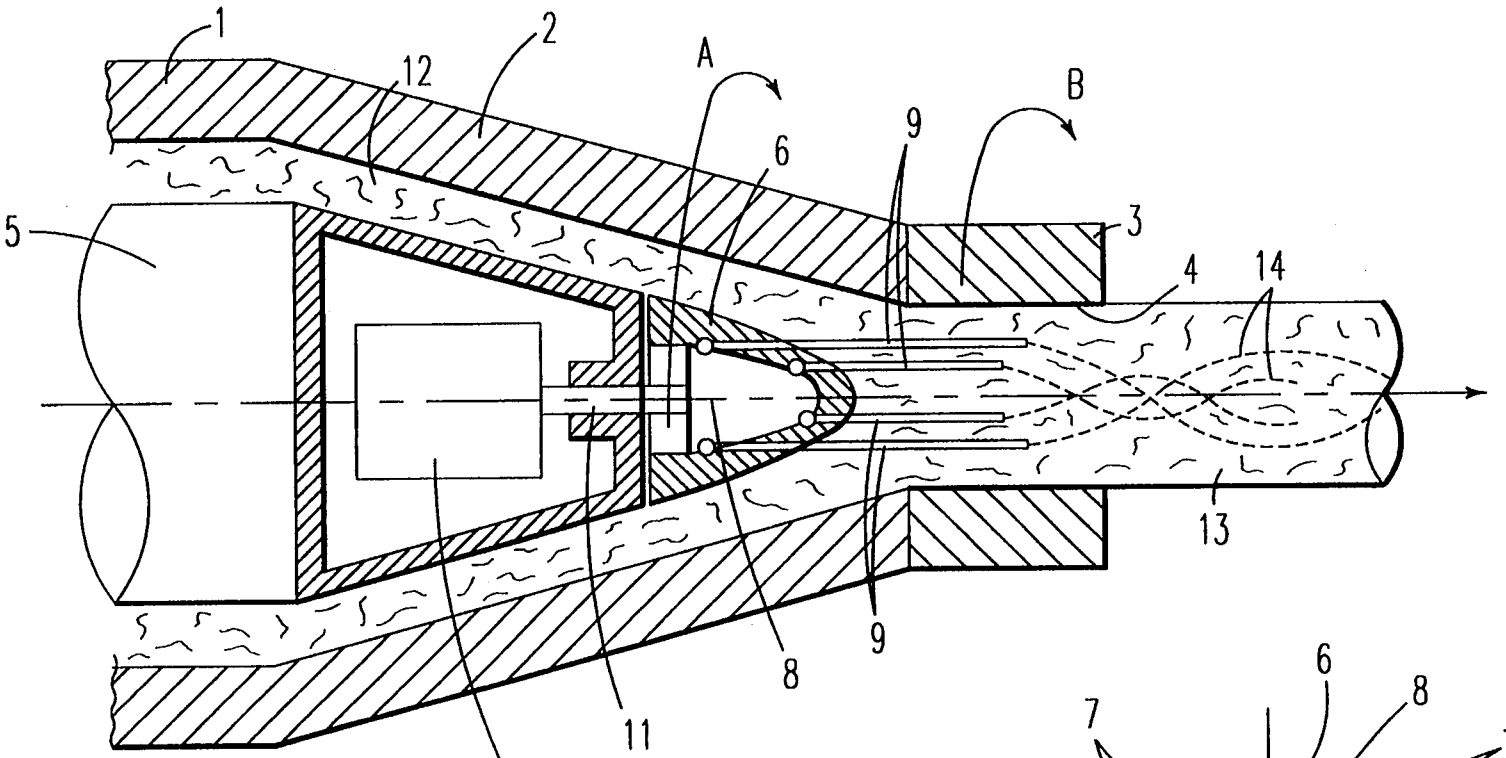
FIG. 1 is a diagrammic longitudinal view of the extrusion tool, which is partially broken away.
Figure 2:
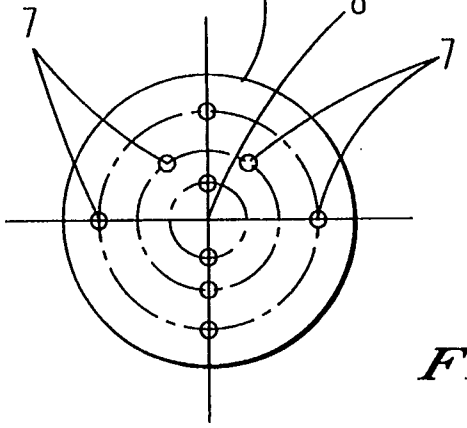
FIG. 2 is a front view of the thread carrier with attachment points for the threads on different divided circles.

The extrusion tool comprises in essence the housing 1, which passes over into the die 2, which is designed as one piece with said housing and tapers off conically. The outer die ring 3 exhibits a smooth cylindrical channel 4 and is designed either as one piece with the die 2 or as a separate piece, as illustrated. Within the extrusion die 2 there is in coaxial arrangement a mandrel 5, to which is attached the thread carrier 6. This thread carrier 6 exhibits the shape of a parabola along the line of a propeller hub and is hollow. As apparent from FIG. 2, several attachment boreholes 7, which lie on different divided circles, i.e. exhibit varying large radial distance from the longitudinal axis 8, are arranged on the thread carrier 6. The respective elastic threads 9 are attached in these boreholes 7, and particularly in a number that matches the number of subsequent, twisted internal boreholes. The threads 9 project into the outer die ring 3. The outer die ring 3 can be designed stationarily. However, it can also be rotatable. The thread carrier 6 can also be designed stationarily or rotatable. In the case of the rotatable design of the thread carrier 8 and the outer die ring 3, a drive is provided in order to set the thread carrier 8 or the outer die ring 3 rotating. In FIG. 1, a drive 10, which communicates by way of the shaft 11 with the thread carrier 6 and sets it rotating, as indicated by the arrow A, is disposed within the mandrel 5. The rotation of the outer die ring 3 is symbolized by means of arrow B. The ceramic or hard metal compound, located within the ring gap 12 between mandrel 5 and housing 1 or die 2, is pressed through the squeezing device, which is not shown in detail (extruder, piston, etc.) past the thread carrier 6 into further processed by sintering.

At this stage there exist various options for producing the twisted internal boreholes 14 in this rod blank 13. First, the thread carrier 6 can be set rotating. In so doing, the carrier 6 is driven from inside by means of the drive 10 at a specific angular velocity, in order to produce the desired twist shape. The extrusion compound is extruded and not rotated. The rotational speed of the thread carrier 6 and the (axial) flow velocity of the extrusion compound determine the angle of inclination of the twist channels 13 that are produced. In another case, where the outer ring die 3 can be rotated and the thread carrier 6 is stationary, i.e. exhibits no drive, the smooth outer die ring 3 is set rotating according to arrow B. It has been demonstrated that the emerging extrusion compound also rotates with virtually no slippage owing to the high squeezing pressure of the squeezing device and the surface friction in the smoothly rotating die 3, even though said die exhibits no projections or the like. Therefore, blanks having exactly twisted internal boreholes are also obtained in this manner. Finally, both the thread carrier 6 and the outer die ring 3 can be designed rotatingly, so that an overlapping of the rotational motion of the die 3 and the thread carrier 6 is obtained. When die and thread carrier rotate in the same direction, the rotation is thus reinforced. When die and thread carrier rotate in the opposite direction, the rotation and thus the twist of the internal boreholes is decreased. The thread carrier 6 can rotate, for example, at constant speed, whereas the rotational speed of the die 3 is variable and eventually compensates for twist defects. To measure the rotational speed of the threads 9 and thus the twist pitch, when the extrusion speed of the compound is known, the ends of the threads 9 bear in the region within the outer die ring 3 metallic or other elements influencing a magnetic field or an electric field. Then the rotational speed can be determined with an externally mounted measuring device (not shown in detail) and be changed depending on the requirements. On the whole, the result is thus a simply constructed extruder, with which rod blanks, whose shell surface is totally smooth and which exhibit internal boreholes that are twisted to high precision can be produced.

Instead of the elastic threads 9, plastic material can also be extruded into the melt stream, in order to produce the twist channels 14. At the same time this plastic material emerges in the shape of a thread from the boreholes 7 of the carrier 6, thus connecting the boreholes 7 also with channels and a suitably designed squeezing chamber or the like (not shown in detail). The plastic, thready material contains as the filler a metallic powder, which affects the magnetic or electric field of a measuring device that is also not depicted in detail and is used to determine the rotational speed. Rod blanks having a smooth shell and exact twist boreholes can also be produced with this variant of the extrusion tool.

I claim:

1. An extrusion press tool for producing a hard metal or ceramic bar having at least one helical inner bore, comprising:

a press nozzle defining a free opening including an opening piece having a smooth cylindrical channel;

a mandrel disposed as a hub body within the press nozzle;

a support disposed coaxially on the mandrel;

a plurality of elastic filaments secured to the support at positions spaced from the axis of said press nozzle, and extending into the free opening for producing inner bores in an extrudable metal or ceramic material as the material is being extruded through the free opening; and a drive mechanism rotatably driving at least one of said opening piece and said support so as to produce a relative rotation between support and said opening piece, whereby said inner bores are helical inner bores.

2. The extrusion tool of claim 1 wherein said drive mechanism is disposed in one of said press nozzle and said mandrel.

3. The extrusion tool of claim 1 wherein said opening piece is rotatably driven by said drive mechanism.

4. The extrusion tool of claim 1 wherein both said opening piece and said support are rotatably driven by said drive mechanism.

5. The extrusion tool of claim 1 wherein said support comprises a hub tapering towards said opening piece.

6. The extrusion tool of claim 5 wherein said hub is hollow and has plural boreholes at different radial positions thereon, said filaments being suspended from said boreholes.

7. The extrusion tool of claim 1 wherein distal ends of said filaments have elements for influencing the magnetic or electric field of the rod.

* * * * *

UNITED STATES PATENT AND TRADEMARK OFFICE

CERTIFICATE OF CORRECTION

PATENT NO. : 5,438,858

DATED : August 8, 1995

INVENTOR(S) : Arno Friedrichs

It is certified that error appears in the above-indentified patent and that said Letters Patent is hereby corrected as shown below:

On the title page, Item [87], the PCT Publishing Number should read: W003/24170

Signed and Sealed this

Ninth Day of January, 1996

*Attest:*

*Attesting Officer*

BRUCE LEHMAN

*Commissioner of Patents and Trademarks*